United States Patent [19]

Schneider

[11] 4,274,548

[45] Jun. 23, 1981

[54] PLASTIC TANK, PARTICULARLY FOR THE STORAGE OF FUEL OIL AND THE LIKE

[76] Inventor: Helmhold Schneider, Kolner Strasse 59, D-5230 Altenkirchen, Fed. Rep. of Germany

[21] Appl. No.: 60,254

[22] Filed: Jul. 23, 1979

Related U.S. Application Data

[63] Continuation of Ser. No. 793,828, May 4, 1977, abandoned.

[30] Foreign Application Priority Data

May 4, 1976 [DE] Fed. Rep. of Germany ..... 2619590
May 21, 1976 [DE] Fed. Rep. of Germany ..... 2622737

[51] Int. Cl.[3] ..... B65D 1/44; B65D 88/02
[52] U.S. Cl. ..... 220/72; 150/0.5
[58] Field of Search ..... 220/72; 150/0.5

[56] References Cited

U.S. PATENT DOCUMENTS

| | | | |
|---|---|---|---|
| 3,330,439 | 7/1967 | Moorman | 220/72 |
| 3,335,902 | 8/1967 | Javorik | 220/72 |
| 3,448,775 | 6/1969 | Limbach | 220/72 |
| 3,552,599 | 1/1971 | Redding | 220/72 |

FOREIGN PATENT DOCUMENTS

| | | | |
|---|---|---|---|
| 2522094 | 11/1976 | Fed. Rep. of Germany | 220/72 |
| 613390 | 12/1960 | Italy | 220/72 |
| 1007563 | 11/1965 | United Kingdom | 220/72 |

*Primary Examiner*—George E. Lowrance
*Attorney, Agent, or Firm*—Sughrue, Rothwell, Mion, Zinn and Macpeak

[57] ABSTRACT

A plastics storge tank for fuel oil and the like is generally a parallelepiped basic shape. The pair of opposed tank walls of greatest dimensions are each provided with at least one channel-shaped horizontal recess. These recesses impart to the tank, as seen in horizontal section, a substantially cylindrical form over at least partial zones of said walls.

20 Claims, 16 Drawing Figures

PLASTIC TANK, PARTICULARLY FOR THE STORAGE OF FUEL OIL AND THE LIKE

This is a continuation, of application Ser. No. 793,828 filed May 4, 1977, now abandoned.

BACKGROUND TO THE INVENTION

This invention relates to a plastics storage tank, and in particular to a tank made of thermoplastic material for use as an individual tank or a tank battery for the storage of, for example, fuel oil.

The invention is concerned in particular with plastics tanks made by blow-moulding and having large dimensions and a correspondingly large capacity, generally of at least 1000 liters.

It is well known that plastics tanks, which are used as individual tanks or tank bateries for the purpose of storing fuel oil and the like, must be strengthened by means of steel straps so as to prevent undesirable bulging of the walls of the tanks under the effect of the static pressure of the fluid contents. The provision and fitting of the steel straps involves considerable additional cost.

For many years it has been known to increase the stability of storage tanks by providing, between the walls of the tanks, reinforcing webs or the like which act as tension flanges. In this connection it has also been proposed, in the production of storage tanks by the blow-moulding process, to fit special prefabricated plastics structural elements in the tank so as to brace and strengthen the tank walls (German Patent Specification OS1947737). In this way, the structural elements have to be introduced into a tube-like plastics blank while the mould is still open and they have to be aligned along the planes in which they are to be secured before the mould is closed and the plastics blank is brought to its final shape by blowing.

It is also known to strengthen the walls of tanks by forming integrally with two of the side walls of the tank substantially funnel-shaped recessed portions which are welded to each other by their base surfaces at a zone located roughly at the centre of the interior of the tank. Although this step results in a reduction in the bulging of the walls of the tank so that the use of special straps can be dispensed with, it has the disadvantage that a substantial part of the capacity of the tank is sacrificed by having to accommodate the funnel-shaped recessed wall portions. In order to offset this loss of capacity, the tank body has to be of considerably larger external dimensions. This leads, among other things, to increased material costs which in turn nullify the savings resulting from the absence of straps. Furthermore, the greater size of these storage tanks causes very considerable disadvantages as regards transportation, stocking and the installation of tank bateries in what are usually constricted spaces.

The main aim of the invention is to provide a large-capacity tank, produced by the blow-moulding method, as an individual tank or tank battery for the storage of fuel oil or other fluids, the walls of which tank are strengthened to such an extent by integral reinforcing means, without however reducing its capacity to an unacceptable degree, that the tank can be used without the addition of costly steel straps and the like. The invention is also concerned with an advantageous and economical method of producing such reinforced plastics tanks by blow-moulding.

SUMMARY OF THE INVENTION

The present invention provides a tank made of plastics material, particularly for use as an individual tank or a tank battery for the storage of fuel oil and the like, the tank being of substantially parallelepiped basic shape, wherein each of one pair of opposed tank walls is provided with at least one horizontally extending channel-shaped recess, the recesses imparting to said walls of the tank, as seen in horizontal section, a substantially cylindrical form over at least partial zones of said walls.

Preferably, the arrangement is such that the channel-shaped recesses extend over the entire width of the tank and to a varying depth corresponding to the cylindrical form of said walls. Here, the arrangement may be such that at least one channel-shaped recess extends around the entire tank. It is readily possible to provide, at each of said two walls of the tank, two or more parallel horizontal channel-shaped recesses having bases each of which forms a cylindrical surface.

Thus, in this plastics tank, the two oppositely disposed large-area walls of the tank of basic parallelepiped form are so formed that, in the zone where the channel-shaped recesses are formed, the tank is of cylindrical cross-section deviating from the rectangular cross-section and having greater rigidity, so that a considerable strengthening of the tank walls (said pair of opposed walls) having the largest dimensions is achieved without excessive loss in capacity. Such a tank can be economically produced without difficulty by the blow-moulding method. Since the static fluid pressure, and therefore the load on the walls of the tank, increases progressively towards the bottom of the tank when the latter is filled, it is preferred to provide in each of said side walls a plurality of channel-shaped recesses so arranged that the top recess is disposed approximately midway along the height of the tank, whereas at least one further recess is formed at a distance below the top recess.

Greater rigidity is achieved in a large-capacity tank if, in accordance with a further feature of the invention, the oppositely disposed channel-shaped recesses in said side walls of the tank extend inwardly in cylindrical formation to the centre of the tank at at least one location in the zone between the end walls of the tank and are joined together at this location. In this case, in addition to the cylindrical form of the tank, mutual support of its side walls is achieved by said recessed portions. Particularly advantageous in this connection is an arrangement wherein vertical grooves, which intersect the channel-shaped recesses, are formed in the oppositely disposed side walls of the tank, the bases of these grooves being interconnected roughly at the centre of the tank.

In accordance with another feature of the invention, the plastics tank has, in at least one of its side walls, at least one recess, which is extended to form a flat web and which constitutes a connecting web which is disposed substantially at right-angles to the side walls of the tank and interconnects the two side walls in the interior of the tank. The extension of such a recess in its side wall to form a relatively narrow connecting web in the form of a flat plate or the like offers the advantage that the capacity of the tank is not appreciably reduced thereby, so that the external dimensions of the tank are not appreciably increased beyond those of existing batteries of like capacity. If the mutually facing surfaces of the narrow recessed portion of the wall are either connected by being directly overlapped, or are indirectly joined by way of an insert to form a solid connecting web, a relatively great thickness is obtained in the web disposed between the two side walls of the tank and forming a tension flange. The thickness of the web can be considerably greater than the actual wall thickness of the tank. It is preferred to use an arrangement such that the recessed portion of the wall, in the zone of transition from the connecting web to the exterior of the tank, forms an open groove having an extended and preferably oval or rectangular contour. If inserts are provided in the integrally formed web or webs, it is preferred to make them of thermoplastic material which can be readily welded to the thermoplastic material of which the tank is made. It will be understood that the oppositely disposed side walls of the tank can be braced by a number of the above mentioned connecting webs that will vary in dependence upon the size of the tank, the webs preferably being arranged vertically though they may also be disposed horizontally. The above mentioned form of tank having at least one connecting web for bracing the two side walls can be achieved particularly advantageously at the same time as the previously mentioned horizontal channel-shaped recesses are being formed, although, if so required the web can be formed without simultaneously forming the channel-shaped recesses.

The plastics tank in accordance with the invention is preferably produced by the blow-moulding process, and the recesses for strengthening and stabilising the walls of the tank can be formed in a tube-like blank. According to the invention, the method of producing the tank is preferably carried out by bringing together the surfaces of the tube forming the plastics blank at the location where the connecting web or webs is or are to be formed, and by welding to form a multi-compartment tube, whereafter the tube is inflated in the closed mould to impart the final shape to the tube.

The bringing together and welding of the walls of the tube of the blank at the location where the connecting web is to be formed are advantageously achieved by means of at least one slide-like mould insert or the like which, after the mould has been closed, is retracted while the tube is being inflated, so as to form the connecting web.

In the method in accordance with the invention, the bringing together and welding of the walls of the tube blank may be expediently carried out during a preliminary blowing operation with the mould still open. In this system it is preferred to retract the slide-like mould insert for forming the connecting web only when the tube is inflated to its substantially final form after the mould has been closed.

If the connecting web is constituted by drawn-in portions of the wall formed on the two oppositely disposed walls of the tank, two mould inserts will of course be necessary, these being displaceably arranged on the two halves of the mould. If the tank is to have a plurality of connecting webs, then a corresponding number of slide-like inserts are provided in the mould.

BRIEF DESCRIPTION OF THE DRAWINGS

Further important features of the invention will be seen from the various claims and from the following description of examples illustrated in the attached drawings, in which:

DESCRIPTION OF PREFERRED EMBODIMENTS

Figure 3:
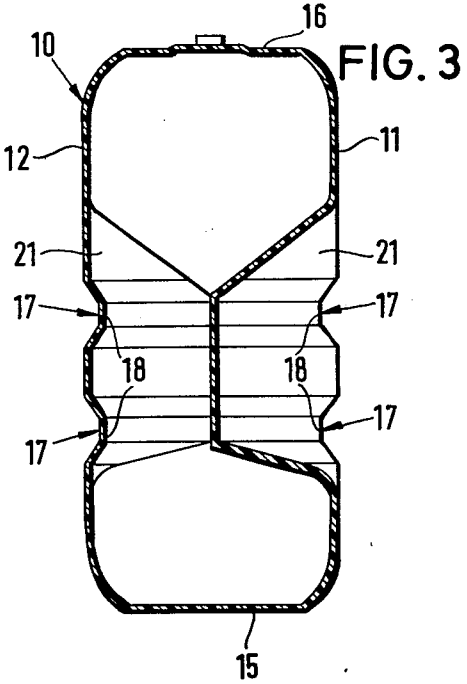
FIG. 3 is a vertical cross-section taken on the line III—III of FIG. 2.

The plastics tanks illustrated in the drawings are intended to be used as individual tanks or tank batteries for the storage of fuel oil and other fluids, and they have a capacity of at least approximately 1000 liters. The plastics tanks 10 are produced from thermoplastic material, such as polyethylene, by the blow-moulding process. As is usual with such tanks, they are basically of parallelepiped shape. Each tank 10 has two parallel side walls 11 and 12, which have the greatest surface dimensions, two parallel end walls 13 and 14, a base 15 and a top surface 16. The top surface 16 is provided with connecting fittings for the charging and dispensing equipment, and for exhausting the tank etc.

In order to stiffen the tank 10 (see FIGS. 1 to 3), and to prevent excessive bulging of the parallel side walls 11 and 12 under the effect of the static pressure of the fluid in the tank, the side walls 11 and 12 are each provided with two parallel channel-shaped recesses 17 which extend horizontally over the entire width of the tank and are of substantially trapezoidal cross-section. The base 18 of each of these recesses 17 forms part of a cylindrical surface, as seen in horizontal section, the arrangement being such that the two recesses 17, disposed opposite each other in pairs, form, over the width of the tank 10, three cylindrical wall configurations which are disposed side-by-side. Each of these wall configurations has a full circular cross-section, the centre-points of the circles lying on the vertical central plane M of the tank 10, and the radii of the arcs being smaller, by approximately the depth of the recesses 17, than the depth of the tank that is the distance between the side walls 11 and 12 outside the deformed zone. The height of the cylindrical surfaces corresponds to the width of the bases 18 of the recesses 17 (see FIG. 2). The end walls 13 and 14 of the tank 10 extend, at 19 in the central plane M of the tank, tangentially to the bases 18 of the recesses 17, the bases 18 being drawn in towards the middle of the tank to form cylinders. In the zone between the end walls 13 and 14 of the tank 10, the oppositely disposed channel-shaped recesses 17 in the two side walls 11 and 12 are drawn in twice towards the central plane M of the tank, so as to form three cylinders, and at the points 20, where they are drawn in, they are connected to each other.

Formed on the oppositely disposed side walls 11 and 12 of the tank 10 are two narrow vertical grooves 21, which vertically intersect the channel-shaped recesses 17 and which, in the central plane M of the tank, are interconnected by their bases to form flat webs 20 which interconnect the cylindrical configurations. The depth of the grooves 21 is equal to half the depth of the tank 10, whereas their lengths are so selected that the upper ends 22 lie above the upper recess 17, and their lower ends 23 are disposed at a distance below the lower recess 17. As shown in FIG. 2, the sides 24 of the grooves 21 run approximately parallel to each other, and they widen slightly in the zones where they merge with the side walls 11 and 12. The webs bear against each other at the centre of the tank 10 and thus extend to the recesses 17 at each side wall 11 or 12. It can be seen from FIG. 1 that the top recess 17 in each of the side walls 11 and 12 of the tank 10 lies approximately in the horizontal central plane of the tank, that is in a plane half-way up the tank, whereas the lower recesses 17 are located at a distance below this top recess. Thus, the tank 10 is strengthened particularly in its lower portion, where the static fluid pressure applied to the tank walls is particularly great.

Figure 1:
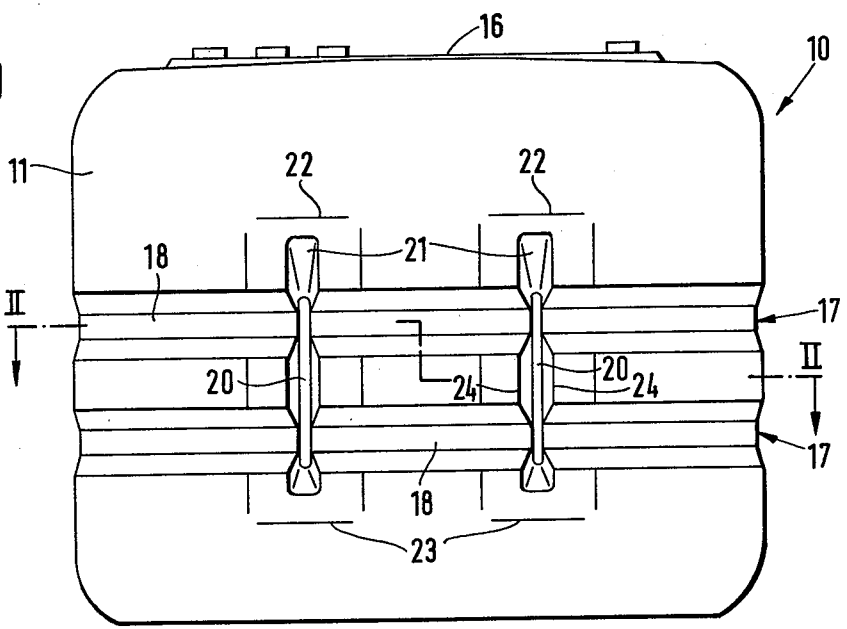
FIG. 1 is a side view of a first form of plastics tank constructed in accordance with the invention.
Figure 2:
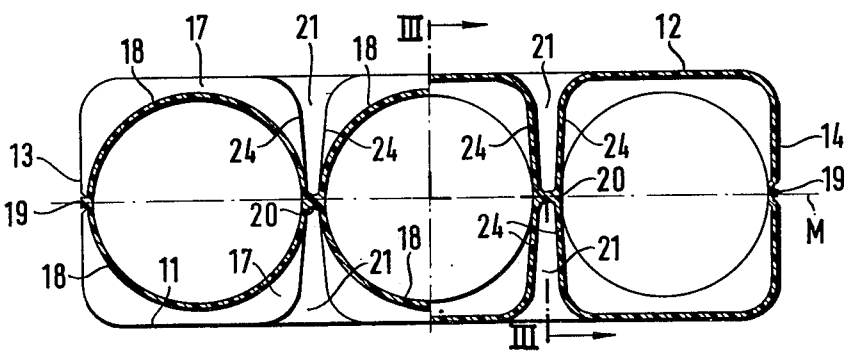
FIG. 2 is a horizontal cross-section through the same tank taken on the line II—II of FIG. 1.

In the example shown in FIGS. 1 to 3, two horizontal parallel channel-shaped recesses 17 and two vertical grooves 21 intersecting these recesses are formed in each side wall 11 and 12 of the tank 10. It would also be possible to provide only one vertical groove 21 at the middle of the tank 10 in each side wall 11 and 12.

Figure 6:
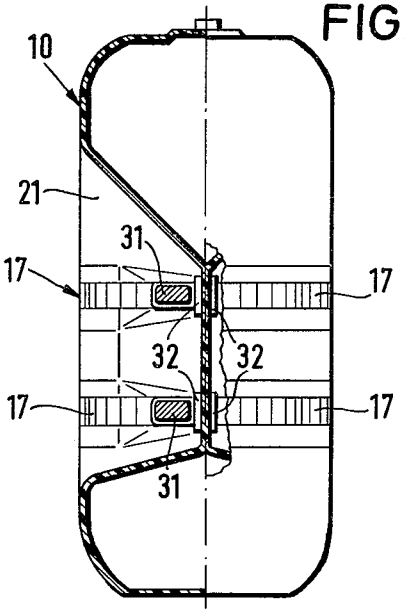
FIG. 6 is an end view, partly in vertical cross-section, of the tank shown in FIGS. 4 and 5.
Figure 4:
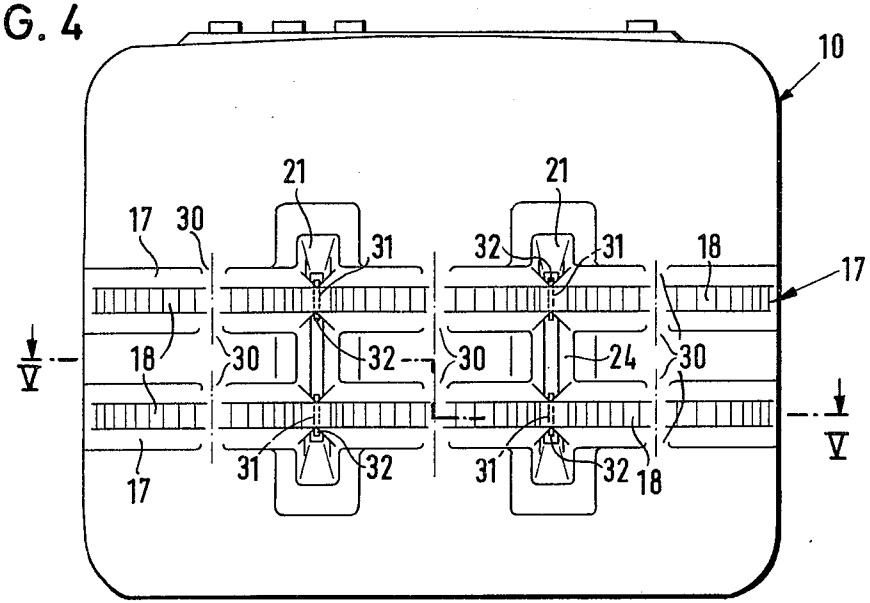
FIG. 4 is a side view of a second form of plastics tank constructed in accordance with the invention.
Figure 5:
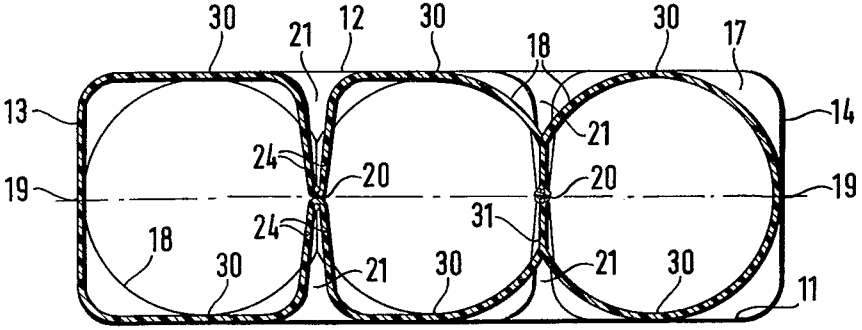
FIG. 5 is a horizontal section through this second form of tank, taken on the line V—V of FIG. 4.

The plastics tank 10 shown in FIGS. 4 to 6 is so formed that the cylindrically formed bases 18 of the channel-shaped recesses 17 terminate, in the zone between the end walls 13 and 14 of the tank, in spaced flat portions 30 each of which extends along the plane of the corresponding side wall 11 or 12 of the tank. The diameter of the arcs that delimit the cylindrical side wall formations of the tank 10 in the zones of the channel-shaped recesses 17 is therefore approximately equal to the depth of the tank in this form of construction, and, as can be seen from FIG. 5, the three arcs intersect each other along the vertical central axis of the grooves 21. The sides 24 of the grooves 21, interconnected by their bases 20 at the middle of the tank 10, are welded together at the level of the channel-shaped recesses 17, short webs 31 thus being formed. Outside the zones of intersection with the horizontal recesses 17 however, the sides 24 of the vertical grooves 21 are not welded as shown on the left in FIG. 5. The sides 24 are here inclined towards each other at an acute angle, and they converge in pairs towards the middle of the tank 10, that is towards the weld 20. In order to keep the bases of the grooves 21 in contact with each other, for establishing the welded joint when forming the short webs 31 in the blow-moulding process, short inserts 32 are provided, and as shown in particular in FIGS. 4 and 6, these inserts lie behind the webs 31. During the blow-moulding operation, the inserts 32 can be applied, as is described below, with the aid of slide-like mould inserts, which are arranged to slid on two halves of the mould and are used for forming the vertical grooves 21 and the web connections 20, 24 and 31 which brace the side walls 11 and 12 of the tank 10.

It will be understood that the number of horizontally extending channel-shaped recesses 17 and the number of grooves 21 which intersect these recesses can be varied in dependence upon the size of the tank 10, and that the cylindrical side wall formations of the tank at the level of the channel-shaped recesses 17 can be delimited by arcs of different diameter which may also be larger than the depth of the tank, that is the distance between the parallel side walls 11 and 12 of the tank.

Figure 7:
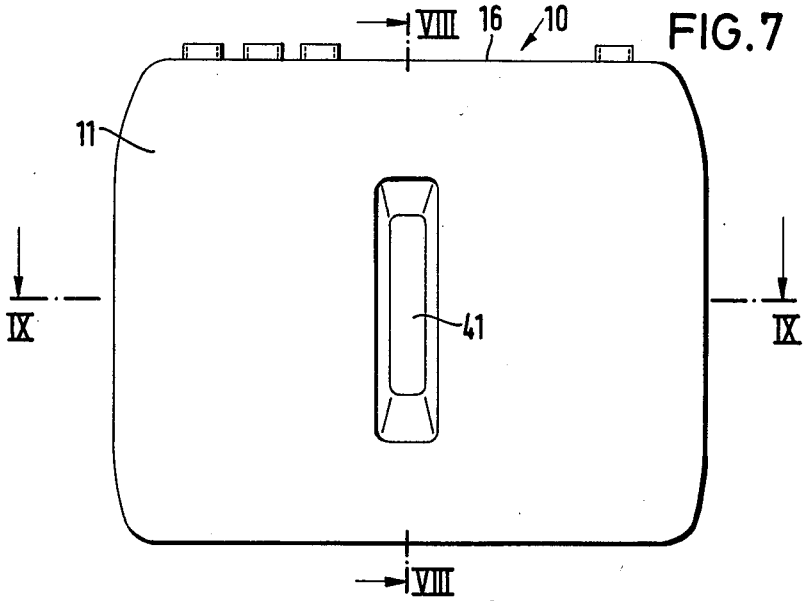
FIGS. 7 to 9 are a side view, horizontal cross-section and vertical cross-section of a third form of plastics tank constructed in accordance with the invention.
Figure 8:
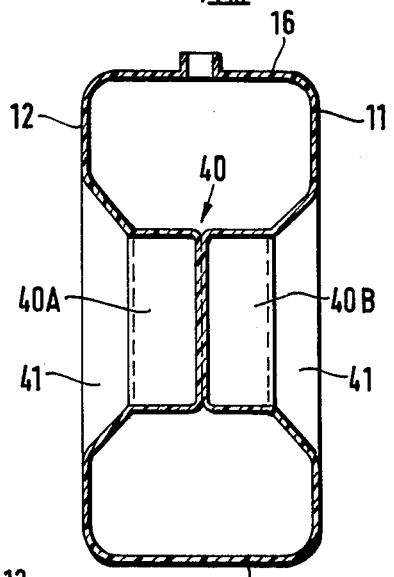
Figure 9:
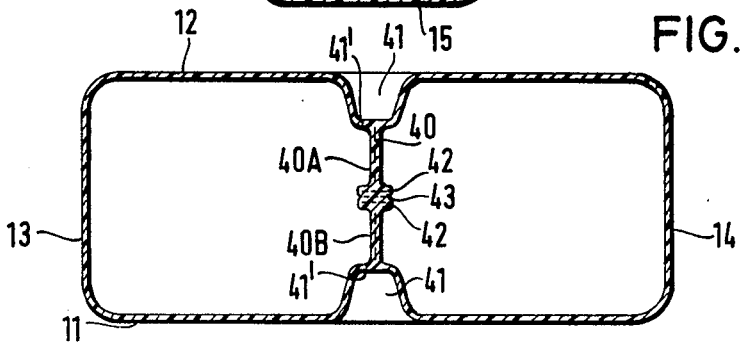

In the plastics tank illustrated in FIGS. 7 to 9, the horizontal channel-shaped recesses are not present. Here the side walls 11 and 12 are interconnected in the central zone by way of a connecting web 40. Formed in the side walls 11 and 12, in the plane of the web 40, are vertical grooves 41 which, as shown in FIG. 7, have an elongate rectangular contour. The bases 41' of the two grooves 41 are interconnected by the narrow web 40. The web 40 consists of a web part 40A which is formed on the side wall 12, and of a web part 40B which lies flush against the web part 40A and is integrally formed with the opposite side wall 11. The two web parts 40A and 40B, which are disposed at right-angles to the side walls 11 and 12, each have at its inner end a portion 42 of greater cross-sectional area whereby they can be welded together at 43.

At those zones of the web parts 40A and 40B that are disposed between the widened portions 42 and the bases 41' of the grooves 41, the web parts have a thickness that is greater than that of the side walls 11 and 12. The connecting web 40, consisting of the parts 40A and 40B, forms a flat web plate, the thickness of which is equal to the length of the base 41' of each groove 41, as shown in FIG. 9.

Figure 14A:
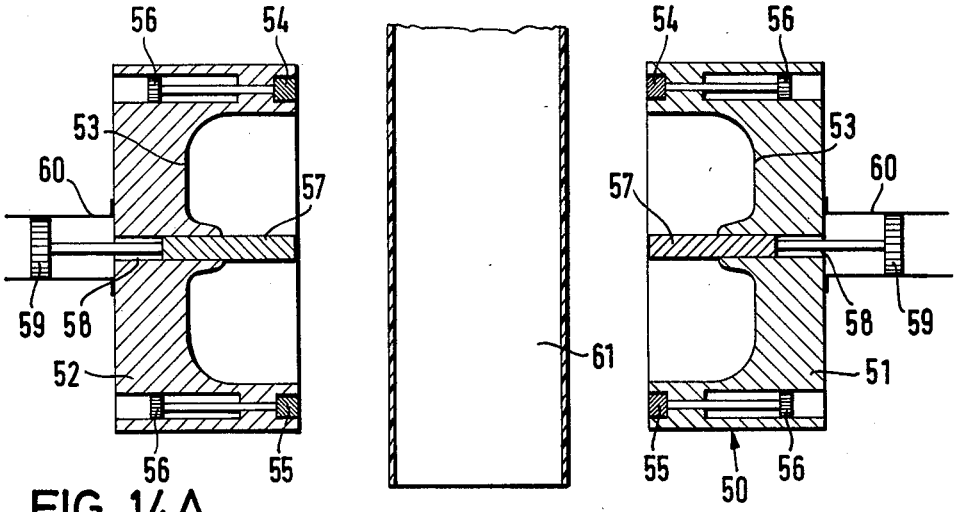
FIGS. 14A to 14C illustrate equipment for producing a plastics tank by the method of the invention.
Figure 14B:
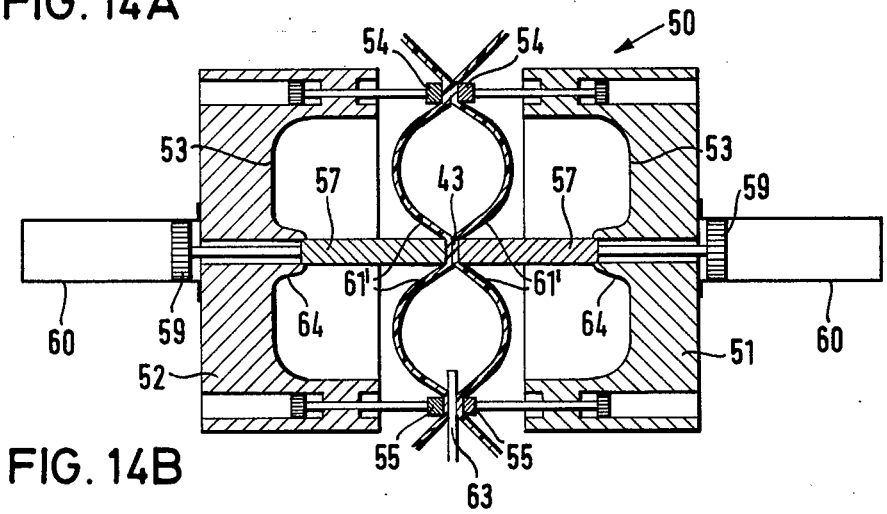
Figure 14C:
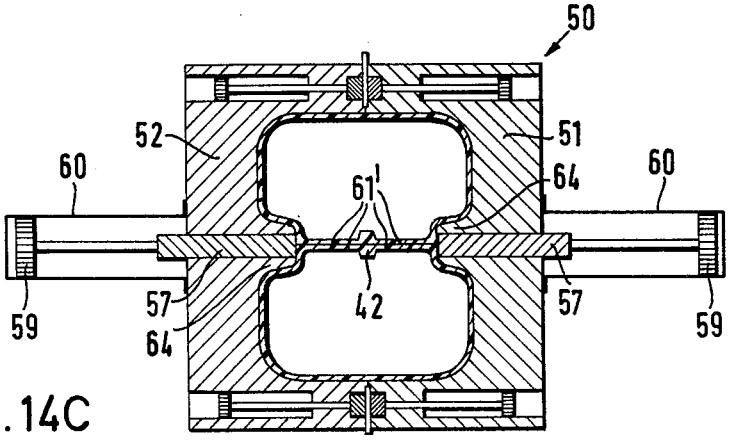

The tank illustrated in FIGS. 7 to 9 is produced by blow-moulding using the apparatus illustrated in FIGS. 14A to 14C. The mould 50 illustrated therein consists of two symmetrical halves 51 and 52, each having an interior formation 53, matching the shape of the tank, and two preliminary compression strips 54 and 55 which can be pushed in, and withdrawn, by means of pneumatic or hydraulic pistons 56. The mould halves 51 and 52 can be moved towards each other from the open position, shown in FIG. 14A, through an intermediate position, shown in FIG. 14B, into the closed position, shown in FIG. 14C, and this movement can be reversed. In the middle portion of the two mould-halves 51 and 52 is arranged a mould insert 57 which consists of a flat slide and is displacable in a guide 58, associated with the mould-halves, and can be slid in the directions in which the mould 50 is opened and closed. The mould inserts 57 are displaced by means of pistons 59 which move in cylinders 60, to which a hydraulic or pneumatic pressure medium can be applied. Instead of the cylinders 60, mechanical displacement means can be used.

FIG. 14A illustrates a tube-like blank 61 of thermoplastic material which has been introduced into the open mould 50. This blank 61 first undergoes a preliminary inflating operation. While this is happening, the mould-halves 51 and 52 are in the intermediate position shown in FIG. 14B. The preliminary compression strips 54 and 55 are extended, so that the tube-like blank 61 is closed at the top and bottom portions of the mould 50. With the aid of at least one blowing nozzle 63, which in this arrangement is fitted in the lower portion of the mould 50, a pressurised medium, for example compressed air, is introduced into the tube-like blank 61. At the start of, or during, the preliminary blowing operation, the mould inserts 57 are moved out of the two mould-halves 51 and 52, as shown in FIG. 14B. This causes the oppositely disposed surfaces of the tubular blank 61 to be brought together at the place where the connecting web 40 is to be formed (see FIGS. 7 to 9), and said surfaces are welded together at 43 so that a multi-compartment tube is formed. The blank 61, welded at its ends by the preliminary compression strips, and at its median zone by the mould inserts 57, is expanded to form bags between the welded zones by introducing further air through the blowing nozzle 63, the thermoplastic material of the blank being stretched in a substantially uniform manner. During or after the preliminary blowing operation the mould 50 is closed on a time-controlled basis.

After the mould 50 has been closed, the tube 61, shaped during the preliminary blowing operation, has acquired substantially the same shape as the mould, so that further blowing in the now closed mould causes it to be further deformed only to a relatively small extent (see FIG. 14C). This mode of operation results in an almost uniform wall-thickness over the entire finished tank, and this has not been possible in the known blow-shaping process in which movable mould inserts are not used.

After the mould 50 has been closed, the mould inserts 57 are withdrawn on a time-controlled basis into the end positions shown in FIG. 14C. The wall parts 61', disposed on the two sides of the slide-like mould inserts 57, are pressed against each other by the internal blowing pressure to form the connecting web 40, and the widened portions 42. The widened portions 42 are welded together using the heat still present inside the blank 61. When the mould inserts 57 have been retracted, there is thus created a web 40 which interconnects the oppositely disposed side walls 11 and 12 of the tank 10 and the thickness of which corresponds approximately to twice the thickness of the tank walls. During formation of the connecting web 40, the grooves 41 are also formed by shoulders 64 projecting from the two halves 51 and 52 of the mould 50.

The above described method can also be carried out by extending the slide-like mould inserts 57 after closing the mould 50 for the purpose of establishing the welded connection 43 and by then retracting them again for the purpose of forming the connecting web 40. Also, the mould inserts 57 need to be only partially extended during the preliminary blowing operation and to an extent such that the tubular blank 61 is able to lie close against the walls of the mould 50 after the latter has been closed. Finally, the mould inserts 57 can be fully extended on a time-controlled basis for establishing the welded connection 43, and then retracted while the connecting web 40 is being formed.

It will be understood that it is also possible, using the above described method to form a plurality of vertical and/or horizontal connecting webs on the tank. It is also possible with the aid of the described method, to form the channel-shaped wall recesses 17, previously described in connection with FIGS. 1 to 6, by means of a suitable configuration of the mould 50.

FIGS. 10 to 13 illustrate further different forms of plastics tank constructed in accordance with the invention wherein inserts are incorporated in connecting webs for stiffening the tank, the arrangement being such that these inserts are surrounded by the material forming the walls of the tank. Expediently, the inserts are made of the same thermoplastic material as the tank, so that they can be solidly welded to the tank walls by using the interior heat in the blank.

Figure 10:
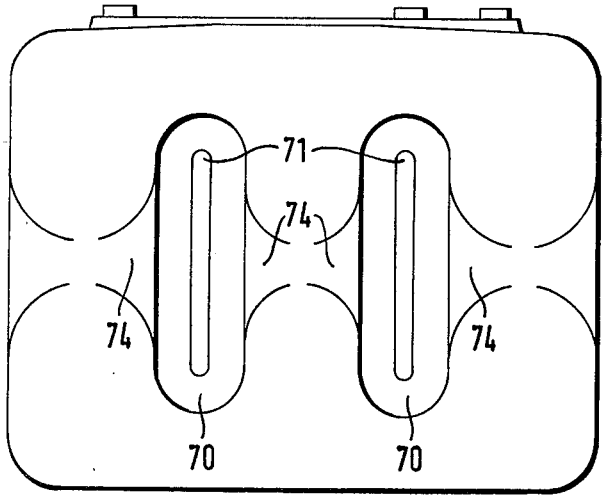
FIGS. 10 and 11 are a side view and a partial horizontal cross-section of a fourth form of plastics tank constructed in accordance with the invention.
Figure 11:
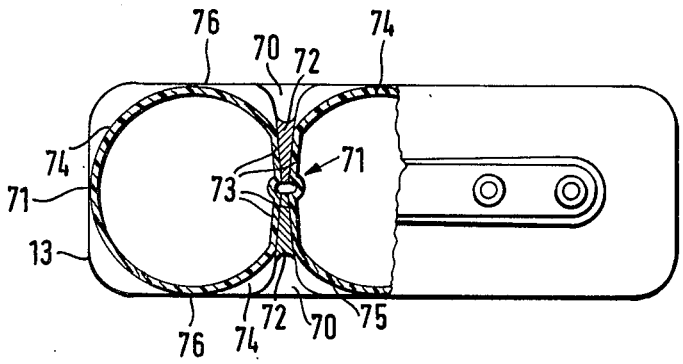

The plastics tank illustrated in FIGS. 10 and 11 has, in each of its side walls 11 and 12, two narrow vertically extending grooves 70 of elongate and substantially oval contour. Connecting webs 71 are formed between the grooves 70 arranged opposite each other in pairs. These webs 71 are provided with inserts 72, which are formed in the grooves 70 and are solidly connected to the lateral surfaces 73 of the these grooves by welding. The inserts 72 are thus substantially covered on all sides by the material of the grooved portions of the walls 11 and 12 of the tank, so that they are firmly bonded in to form thick-walled connecting webs 71.

It can be seen from FIGS. 10 and 11 that the tank, of basic parallelepiped shape, has, in the zone of the two connecting webs 71, substantially cylindrical wall recesses 74 which, as shown in FIG. 11, have a diameter equal to the depth of the tank, that is to the distance between the side walls 11 and 12. The connecting webs 71 form chords to the arcs 75 of the cylindrical recesses 74 in the walls 11 and 12. Those portions of the walls of the tank that extend outwardly from the connecting webs 71 are circular in the horizontal section seen in FIG. 11 so that the outer surfaces of the flat parallel side walls 11 and 12, and of the end walls 13 and 14, are tangential to these circular portions at 76 and 77 respectively. Thus, seen in horizontal section, the parallelepiped tank is made up of a plurality of circular segments which, in the zone between the end walls 13 and 14, on the one hand, and the adjacent connecting web 71 as well as the parallel connecting webs, on the other, each constitute a cylindrical formation of the wall of the tank. It is possible to shape the channel-shaped recess 74 in the wall in such a way that it extends substantially over the entire thickness of the connecting web.

The production of the tank illustrated in FIGS. 10 and 11 is carried out by the blow-moulding process in the manner described above by using suitable moulds, the inserts 72 being moulded into the grooves 70 in the walls 11 and 12. It is, however, also possible to dispense with the inserts 72 and to interconnect the surfaces 73 of the grooves 70 in the median zone by welding. The tank may also be produced in the manner described in connection with FIGS. 14A to 14C.

Figure 12:
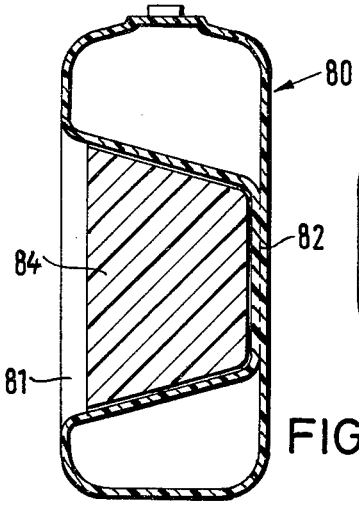
FIGS. 12 and 13 are a vertical cross-section and horizontal cross-section respectively of a fifth form of plastics tank constructed in accordance with the invention.
Figure 13:
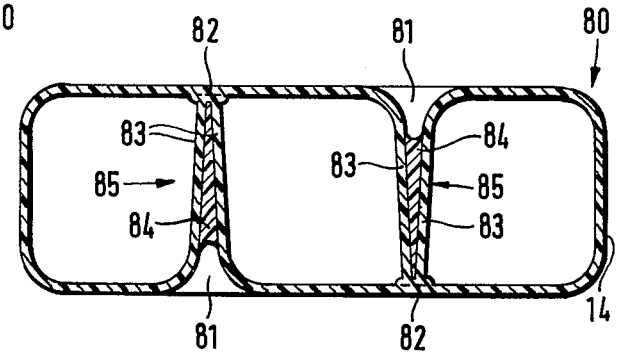

FIGS. 12 and 13 illustrate a further plastics tank 80 wherein connecting webs are formed by providing recesses in the form of narrow grooves 81 in the two side walls 11 or 12 of the tank. Only one groove 81 is formed in each of the side walls 11 and 12, the material forming each groove being welded at 82 to the opposite side wall 11 or 12. Moulded in from the outside, and disposed between the two lateral surfaces 83 defining each groove 81, is an insert 84 which is integrally connected to the lateral surfaces 83 by welding in the previously described manner. The tank in this case also has two vertical connecting webs 85, one of which is formed from the material of the wall 11, and the other from the material of the wall 12.

It will be understood that in all the above described forms of construction, the number of integrally formed connecting webs, grooves and channel-shaped recesses in the walls can be varied to suit the particular tank dimensions, and that the connecting webs can extend not only vertically but also horizontally or both vertically and horizontally.

I claim:

1. A blow-molded plastics storage tank comprising a substantially parallelepiped basic shape and strengthened by at least one elongated recess extending across a pair of opposed tank walls, and at least one rectilinear elongated groove extending perpendicular to the at least one recess, each groove intersecting each recess in the same wall and extending beyond the at least one recess and each groove having a base portion forming a flat web which is disposed parallel to and attached to the flat web of a corresponding groove in the opposite tank wall, whereby the said tank walls are interconnected and supported relative to one another by said webs in the interior of the tank.

2. A tank according to claim 1, wherein said tank walls are the walls of the tank having the greatest dimensions.

3. A tank according to claim 1, wherein the grooves have bases directly interconnected, whereby said tank walls are supported relative to one another.

4. A tank according to claim 1, wherein the grooves have bases interconnected by means of an insert, whereby said tank walls are supported relative to one another.

5. A tank according to claim 1, wherein the facing surfaces of the webs defined by the grooves are directly opposed to one another.

6. A tank according to claim 5, wherein said facing surfaces are welded to each other in overlapping relationship, at least along parts of said surfaces.

7. A tank according to claim 5, wherein said surfaces are interconnected, at least over parts thereof, by prefabricated inserts which are introduced into the grooves from the outside.

8. A tank according to claim 1, wherein the groove of one of said tank walls extends towards the other of said tank walls and the base of that groove is welded to said other tank wall, and the groove of said other tank wall extends towards said one tank wall and the base of that groove is welded to said one tank wall.

9. A tank according to claim 8, wherein a respective prefabricated insert is provided within each of said grooves, the inserts being introduced into the grooves from the outside.

10. A tank according to claim 5, wherein the ends of each pair of opposed webs are welded together and to form a continuous connecting web in the interior of the tank.

11. A blow-molded storage tank comprising plastics materials of substantially parallelepiped basic shape and with a pair of opposed tank walls having the greatest dimensions each having at least one elongated channel-shaped recess extending horizontally across said pair of opposed tank walls, the recesses imparting to said walls of the tank, as seen in horizontal section, a substantially cylindrical form over at least partial zones of the walls, each channel-shaped recess extending over the entire width of the tank and to a varying depth corresponding to the cylindrical form of said walls, at least one elongated vertical groove formed in each of said walls of the tank, each groove intersecting each channel-shaped recess in the same wall, each groove having a length less than the height of the tank and greater than the width of a channel-shaped recess and extending beyond the at least one recess, and each groove having a base portion interconnected to the opposite wall, whereby said walls are supported relative to one another.

12. The tank of claim 11, wherein the base portion of each groove is attached to the base portion of a corresponding groove in the opposite tank wall.

13. A tank according to claim 11, wherein at least one channel-shaped recess extends around the entire tank.

14. A tank according to claim 13, wherein the diameter of the cylindrical surface defined by each of the bases of the channel-shaped recesses, is not greater than the distance between said walls of the tank.

15. A tank according to claim 13, wherein the uppermost channel-shaped recess is disposed approximately midway along the height of the tank.

16. A tank according to claim 11, wherein at least two parallel horizontal channel-shaped recesses, each having a base which forms part of a cylindrical surface, are provided in each of said walls of the tank.

17. A tank according to claim 11, wherein the channel-shaped recesses in said walls of the tank extend inwardly in cylindrical formation to the centre of the tank at at least one location in the zone between a second pair of opposed tank walls, and are joined together at this location.

18. A tank according to claim 11, wherein one groove is formed in each of said tank walls at the middle of the tank.

19. A tank according to claims 11, wherein two parallel vertical grooves are formed in each of said tank walls, the grooves of each of said tank walls being disposed symmetrically about the vertical axis of symmetry of that wall.

20. A blow-molded storage tank comprising plastics material of substantially parallelepiped basic shape and with a pair of opposed tank walls having the greatest dimensions each having at least one elongated channel-shaped recess extending horizontally across said pair of opposed tank walls, the recesses imparting to said walls of the tank, as seen in horizontal section, a substantially cylindrical form over at least partial zones of the walls, each channel-shaped recess extending over the entire width of the tank and to a varying depth corresponding to the cylindrical form of said walls, at least one elongated vertical groove formed in at least one of said walls of the tank, each groove intersecting each channel-shaped recess in the same wall, each groove having a length less than the height of the tank and greater than the width of a channel-shaped recess and extending beyond the at least one recess, and each groove having a base portion interconnected to the opposite wall, whereby said walls are supported relative to one another.

* * * * *